US008141873B2

(12) United States Patent
St. Ours et al.

(10) Patent No.: US 8,141,873 B2
(45) Date of Patent: Mar. 27, 2012

(54) METHOD AND DEVICE FOR A COMBINED SIGNATURE DIVERTER AND SLOWDOWN DEVICE

(75) Inventors: Joseph Adrian St. Ours, Lee, NH (US); Kevin Lauren Cote, Allen, TX (US); Lothar John Schroeder, West Chester, OH (US)

(73) Assignee: Goss International Americas, Inc., Durham, NH (US)

( * ) Notice: Subject to any disclaimer, the term of this patent is extended or adjusted under 35 U.S.C. 154(b) by 121 days.

(21) Appl. No.: 12/472,304

(22) Filed: May 26, 2009

(65) Prior Publication Data

US 2009/0315255 A1 Dec. 24, 2009

Related U.S. Application Data

(60) Provisional application No. 61/128,670, filed on May 23, 2008.

(51) Int. Cl.
*B65H 39/10* (2006.01)

(52) U.S. Cl. ..... 271/303; 271/302

(58) Field of Classification Search ..... 271/302, 271/303, 300; 198/601, 606, 608
See application file for complete search history.

(56) References Cited

U.S. PATENT DOCUMENTS

| | | | | |
|---|---|---|---|---|
| 4,373,713 | A * | 2/1983 | Loebach | 271/303 |
| 4,729,282 | A * | 3/1988 | Kasdorf | 83/26 |
| 5,607,146 | A * | 3/1997 | Novick et al. | 270/42 |
| 5,615,878 | A * | 4/1997 | Belanger et al. | 271/302 |
| 6,129,352 | A * | 10/2000 | Stab | 271/302 |
| 6,244,593 | B1 * | 6/2001 | Schaefer et al. | 271/270 |
| 6,302,391 | B1 | 10/2001 | Robert | 271/182 |
| 6,302,392 | B1 | 10/2001 | Schaefer et al. | 271/283 |
| 6,394,445 | B1 | 5/2002 | d'Agrella et al. | 271/182 |
| 6,572,097 | B2 | 6/2003 | d'Agrella et al. | 271/182 |
| 6,572,098 | B2 | 6/2003 | Schaefer et al. | 271/186 |
| 6,612,213 | B1 * | 9/2003 | Bredenberg et al. | 83/102 |
| 7,044,902 | B2 * | 5/2006 | d'Agrella et al. | 493/224 |
| 2002/0043757 | A1 | 4/2002 | d'Agrella et al. | 271/182 |
| 2002/0074721 | A1 | 6/2002 | Schaefer et al. | 271/302 |
| 2007/0158903 | A1 | 7/2007 | Cote et al. | 271/270 |

* cited by examiner

*Primary Examiner* — Kaitlin Joerger
*Assistant Examiner* — Patrick Cicchino
(74) *Attorney, Agent, or Firm* — Davidson, Davidson & Kappel, LLC

(57) ABSTRACT

A device for diverting printed products is provided. The device includes a first rotating support having a first pad mounted thereon, a second rotating support having a second pad mounted thereon, a third rotating support having a third pad mounted thereon and a fourth rotating support having a fourth pad mounted thereon. The first pad has a different thickness than the second pad and the first and second rotating supports rotate together. The third pad has a different thickness than the fourth pad and the third and fourth rotating supports rotate together. A method for diverting printed products is also provided.

16 Claims, 3 Drawing Sheets

METHOD AND DEVICE FOR A COMBINED SIGNATURE DIVERTER AND SLOWDOWN DEVICE

This claims the benefit of U.S. Provisional Application No. 61/128,670 filed on May 23, 2008 and hereby incorporated by reference herein.

BACKGROUND

The present invention relates generally to printing presses and more particularly to slowdown devices and diverters used for transporting and decelerating signatures.

U.S. Pat. No. 6,612,213, hereby incorporated by reference herein, discloses a method for cutting a web and diverting signatures which includes the steps of partially cutting the web so as to form a partially cut web section; cutting the partially cut web section with a cutting device so as to form signatures; passing a first belt through at least a part of the cutting device; and holding the signatures between the first belt and a second belt so that the signatures are offset in an alternating fashion to define a first stream and a second stream of the signatures.

U.S. Pat. No. 6,572,097 discloses a sheet diverter that receives a fast moving stream of regularly spaced apart signatures from a sheet processing system. The sheet diverter sends the signatures down one of a plurality of collation paths. A signature slow down mechanism is positioned within the collation path, such that as a signature travels down the collation path, the signature slow down mechanism grabs a tail end of the signature to slow down the speed of the signature. A pair of rotating cam lobes lying in general face-to-face relation along the collation path effectively reach into the collation path at the appropriate moment to grab the trailing end of the signature therebetween.

U.S. Pat. No. 6,572,098 discloses a diverter assembly for diverting signatures from a diverter path to a desired one of a plurality of collation paths. A pair of spaced apart, rotating diverter rolls have respective travel paths which define a common swipe path for the diverter rolls. A diverter wedge which separates the plurality of collation paths is positioned between the pair of diverter rolls such that a portion of the diverter rolls allows for increased control over signatures traveling through a folder as compared to prior known apparatus and methods thereby allowing for greater operational speeds, decreasing signature damage, less ink offset to the diverter wedge and reducing jamming tendencies in a folder.

BRIEF SUMMARY OF THE INVENTION

In a printing operation, printed products move through a printing press at maximum press speeds which may be considerably faster than speeds that can be accommodated in equipment downstream such as folders, and more specifically, choppers and fans. Slowing down the printed products reduces forces acting on the printed products, allows for better control of the printed products and produces more accurate final products.

In known printing press equipment a deceleration mechanism may be utilized to decelerate printed products as printed products exit a printing section of a printing press, before entering a folder. The deceleration mechanism implements mechanical structures that engage and decelerate the individual printed products. The constant stress of multiple decelerations for a substantial number of signatures encountered in commercial printing operations causes durability problems with known deceleration solutions.

Typically diverters and slowdowns will be used in conjunction with each other to slowdown and separate the printed product stream. There may be one diverter and two slowdowns, each slowdown device receiving a stream of printed products from the diverter. The diverter and slowdown devices are two independent parts of the folder, each requiring large amounts of space which makes the folder longer and taller than otherwise required. A significant portion of the overall cost of the folder may be attributed to the diverter and slowdown devices due to the complexity and spatial requirements of their setup.

An object of the present invention provides reducing the complexity and spatial requirements required by diverters and slowdown devices which may result significant cost savings.

By advantageously providing a device for diverting and decelerating printed products the overall size, cost and complexity of a folder is reduced.

The present invention provides a device for diverting printed products. The device includes a first rotating support having a first pad mounted thereon, a second rotating support having a second pad mounted thereon, a third rotating support having a third pad mounted thereon and a fourth rotating support having a fourth pad mounted thereon. The first pad has a different thickness than the second pad and the first and second rotating supports rotate together. The third pad has a different thickness than the fourth pad and the third and fourth rotating supports rotate together.

The present invention further provides a method for diverting printed products. The method includes the steps of rotating a first support having a first pad mounted thereon and a second support having a second pad mounted thereon, the first pad having a thickness different than the second pad, rotating a third support having a third pad mounted thereon and a fourth support having a fourth pad mounted thereon, the third pad having a thickness different than the fourth pad, transporting a first printed product between the first pad and second pad via a first path and transporting a second printed product between the third pad and fourth pad via a second path.

BRIEF DESCRIPTION OF THE DRAWINGS

A preferred embodiment of the present invention will be elucidated with reference to the following drawings, in which.

DETAILED DESCRIPTION OF A PREFERRED EMBODIMENT

Figure 1:
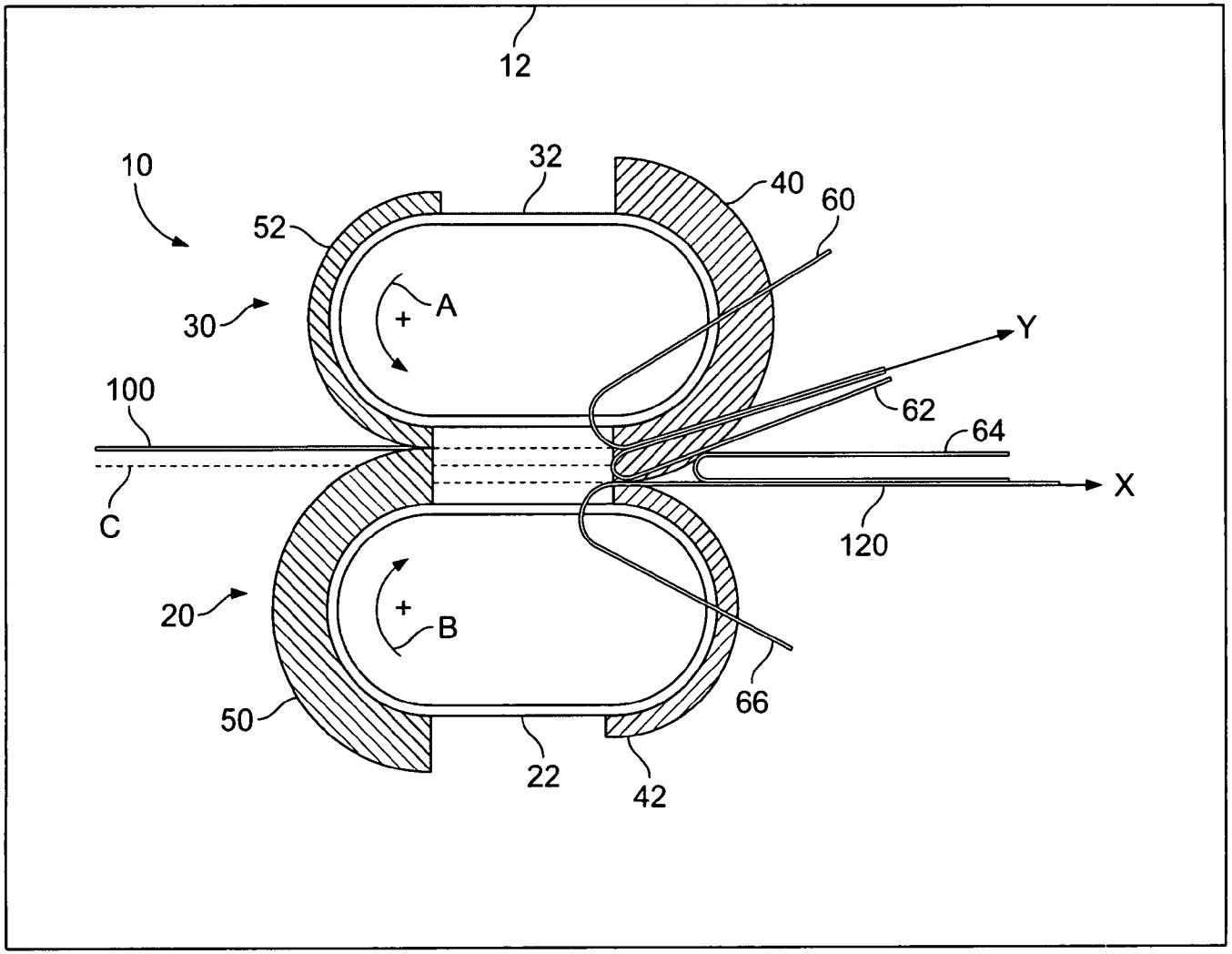
FIG. 1 shows a side view of a diverter and slowdown device according to the present invention.
Figure 2:
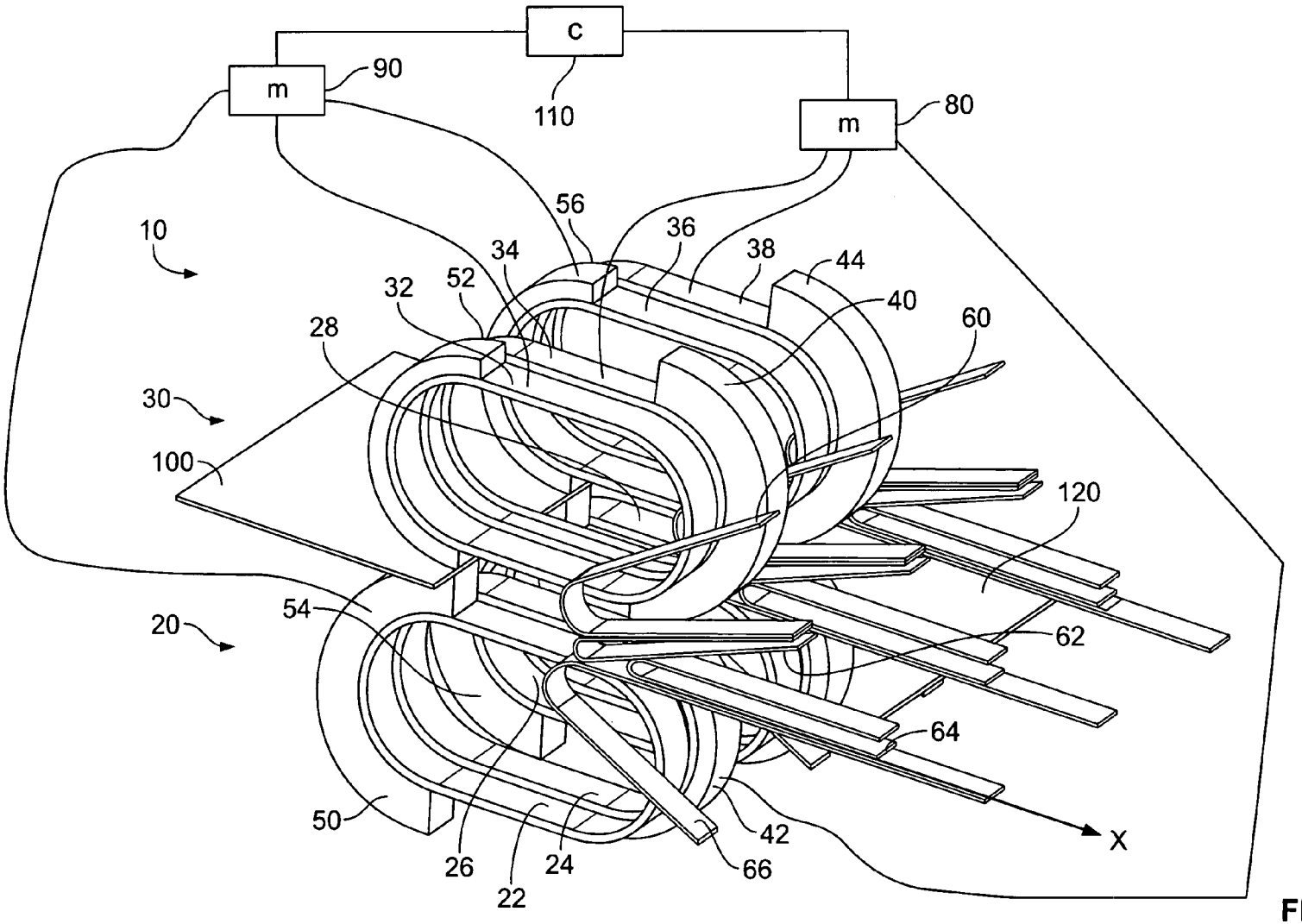
FIG. 2 shows a three dimensional view of the diverter and slowdown device shown in FIG. 1.

FIG. 1 shows a diverter and slowdown device 10 having a lower segment 20 and an upper segment 30 inside a folder 12. As shown in FIGS. 1 and 2, lower segment 20 includes rotating supports 22, 24, 26, 28 which rotate in a clockwise direction B. Upper segment 30 includes corresponding rotating supports 32, 34, 36, 38 which rotate in a counterclockwise direction A and rotate together with rotating supports 22, 24, 26, 28 respectively. A pair of rotating supports 22, 32, and a second pair of rotating supports 26, 36 are connected to a variable speed motor 90 and form a first set of rotating supports. A third pair of rotating supports 24, 34 and a fourth pair of rotating supports 28, 38 are connected to a variable speed motor 80 and form a second set of rotating supports. The second set of rotating supports is offset from and interspersed between the first set of rotating supports. The first and second sets of rotating supports are driven and operated independently from each other via respective motors 90, 80. A controller 110 controls motors 80, 90. First and second sets of rotating supports receive and control alternating products entering device 10. The first, second, third and fourth rotating supports may be belts.

The first set of rotating supports includes a pad arrangement that defines upper path Y. Pad 52 is mounted on support 32 and pad 54 is mounted on support 26. Pad 50 is mounted on support 22 and pad 56 is mounted on support 36. The thickness of pads 52 and 54 may be greater than a thickness of pads 50 and 56. Since pads 50, 56 are thicker than pads 52, 54, pads 50, 52, 54, 56 define a travel path, upper path Y that is above a centerline C of device 10.

The second set of rotating supports includes a pad arrangement that defines lower path X. Pad 42 is mounted on support 24 and a corresponding pad is mounted on support 28. Pad 40 is mounted on support 34 and pad 44 is mounted on support 38. The thickness of pads 40 and 44 may be greater than a thickness of pad 42 and the corresponding pad mounted on support 28. Since pads 40, 44 are thicker than pad 42; pads 40, 42, 44 and the corresponding pad define a travel path, lower path X that is below centerline C of device 10. The variation in pad thickness between pads 52 and 50 and pads 42 and 40 displaces paths Y and X above and below the centerline C of device 10, respectively, creating two streams of product outflow.

Products 100, 120 enter diverter and slowdown device 10 on the left and exit on the right. Transport belts 60, 62, 64, 66 are arranged on an exit side of diverter and slowdown device 10 to provide two separate exit paths along upper path Y and lower path X. A product 120 is shown exiting device 10 along lower path X between transport belts 64 and 66. Product 120 was under the control of the second set of rotating supports including pads 40, 42, 44, decelerated to an exit speed, diverted to path X and exits via transport belts 64, 66.

A product 100 shown entering device 10 is being gripped by the first set of rotating supports including pads 50, 52, 54, 56 mounted on first and second pairs of rotating supports 22, 32 and 26, 36. The first set of rotating supports acts on product 100 to decelerate the speed of product 100 and divert product 100 to exit between transport belts 60 and 62 via upper path Y.

The first and second sets of rotating supports work to decelerate and divert alternating products entering device 10. Pads 50, 52, 54, 56 and pads 40, 42, 44 may be the same length as a length of the longest product in the direction of travel. Thus, products 100, 120 passing through device 10 are constrained and controlled along their entire length during deceleration and diverting which reduces product skewing.

Variable speed motors 80, 90 control the speed of rotating supports, 22, 24, 32, 34, 36, 38. Variable speed motors 80, 90 may be similar to those disclosed in U.S. Publication 2007/0158903, hereby incorporated by reference herein. Motors 80, 90 are connected to and controlled by a controller 110.

Motor 90 is connected to rotating supports 22, 32, 26, 36. Motor 80 is connected to rotating supports 24, 34, 28, 38. Motors 80, 90 may be controlled to operate in cyclical, more specifically, sinusoidal, speed variation cycles that are out of phase with each other, for example by 180°, so motor 90 is at maximum acceleration when motor 80 is at maximum deceleration. Each motor 80, 90 operates at a maximum speed when pads located on corresponding rotating supports gain control of an incoming product. Motors 80, 90 then decelerate the rotating supports and product to a minimum speed for exit out of device 10. Motors 80, 90 then accelerate the speed of the corresponding rotating supports until the supports reach the maximum speed at which time the rotating supports are ready to receive a further incoming product. The minimum speeds of motors 80, 90 may be set to match the speed of equipment downstream or as desired. The maximum speed may be set to match the speed of incoming products, for example, a printing section press speed or as desired.

As shown in FIG. 2, product 120 is being released by pads 40, 42, 44 and exits device 10 via lower path X. Product 120 was slowed down to due motor 80 decelerating the speed of rotating supports 24, 34, 28, 38. After release, motor 80 begins accelerating so pads 40, 42, 44 contact the next incoming product at maximum speed. Simultaneously, motor 90 is operating at maximum speed as product 100 enters device 10 and is gripped by pads 50, 52, 54, 56. Motor 90 decelerates and slows down the speed of product 100 which is diverted to upper path Y via pads 50, 52, 54, 56. Upon exit of product 100 from device 10, motor 90 is operating at a minimum slowdown speed. Motor 90 is then accelerated back up to maximum speed before receiving the next incoming product. Variable speed motors 80, 90 are controlled to cyclically decelerate and accelerate until each product in the product stream is slowed down and diverted.

Figure 3:
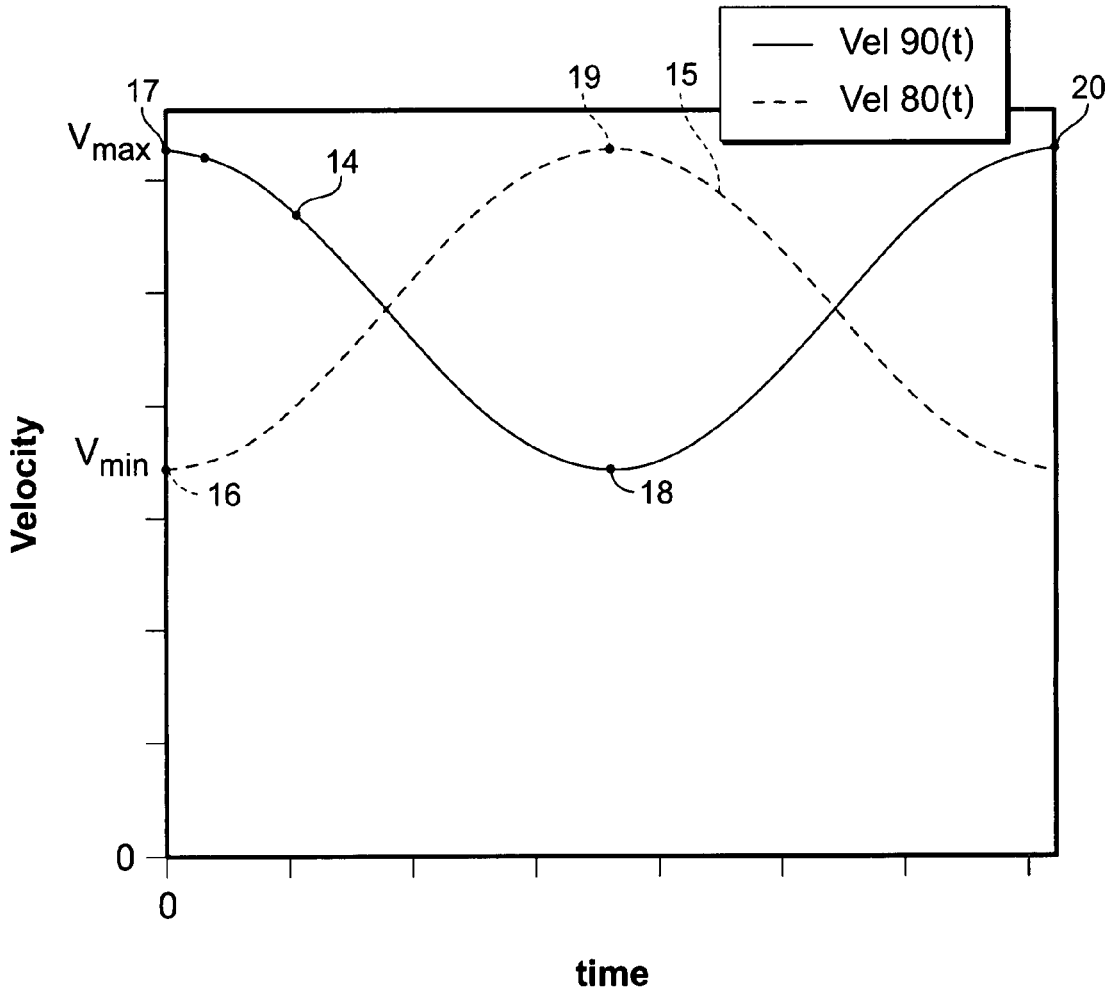
FIG. 3 shows velocity profile curves for the diverter and slowdown device shown in FIGS. 1 and 2.

According to a preferred embodiment of the present invention, variable speed motors 80, 90 are controlled to operate in a sinusoidal speed variation cycle as illustrated by, for example, solid line velocity profile curve 14 depicted in FIG. 3 representing the velocity profile of motor 90 and dashed line velocity profile curve 15 depicted in FIG. 3 representing the velocity profile of motor 80. The speed of motor 90 is at a maximum $V_{MAX}$ at a point 17 when pads 50, 52, 54, 56 receive incoming product 100 moving at a high press speed. The speed of motor 90 is controlled to continuously decelerate the first set of rotating supports 22, 32, 26, 36. At a point 18, the speed of motor 90 is at a minimum, $V_{MIN}$, to match the operating speed of downstream equipment, for example, choppers and fans. Product 100 also is slowed to the minimum velocity $V_{MIN}$ and exits device 10 via upper path Y at the minimum velocity $V_{MIN}$. After discharge of product 100 from device 10, the speed of motor 90 is controlled to accelerate back to maximum speed $V_{MAX}$. At point 20, motor 90 is at maximum speed $V_{MAX}$ and pads 50, 52, 54, 56 are in position to receive another incoming product for deceleration and diverting.

Motor 80 is controlled by controller 110 to operate out of phase with motor 90, for example, by 180°, so motor 80 is at minimum velocity $V_{MIN}$ when motor 90 is at a maximum velocity $V_{MAX}$ and motor 80 is at a maximum velocity $V_{MAX}$ when motor 90 is at a minimum velocity $V_{MIN}$. For example, minimum velocity $V_{MIN}$ for motor 80 occurs at a point 16, when pads 40, 42, 44 are releasing product 120 which occurs while pads 50, 52, 54, 56 are receiving product 100 and motor 90 is at maximum velocity $V_{MAX}$ at point 17. Velocity curve 15 is at a maximum once motor 90 has accelerated back up to maximum velocity $V_{MAX}$ and pads 40, 42, 44 are in a position to receive another incoming product.

This sequence of accelerating and deceleration of the first and second sets of rotating supports continues such that alternating signatures entering device 10 at maximum speeds are gripped by pads, alternating on the first and second sets of rotating supports. The rotating supports operate through alternate periods of deceleration and acceleration 180° out of phase with each other to decelerate each of the incoming signatures from an incoming press speed to a slower speed suitable for operation in downstream equipment.

Multiple sets of upper and lower rotating supports and transport belts may be used with pads having various heights in such a way to divert and decelerate signatures into a plurality of paths. The number of rotating supports and transport belts is limited only by the ability of motors to accurately control the belts and space restrictions.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A device for diverting printed products comprising:

a first rotating support having a first pad mounted thereon;

a second rotating support having a second pad mounted thereon, the first pad having a different thickness than the second pad, the first and second rotating supports rotating together;

a third rotating support having a third pad mounted thereon;

a fourth rotating support having a fourth pad mounted thereon, the third pad having a different thickness than the fourth pad, the third and fourth rotating supports rotating together;

a first motor for controlling the first and second rotating supports; and a second motor for controlling the third and fourth rotating supports, the second motor being out of phase with respect to the first motor.

2. The device as recited in claim 1 wherein the first pad and the second pad receive the first printed product and define a first product path.

3. The device as recited in claim 2 wherein the first pad and second pad are as long as the first printed product in the direction of the first product path.

4. The device as recited in claim 2 wherein the first printed product is received at a first speed and exits the first and second pads at a second speed.

5. The device as recited in claim 4 wherein the first speed is greater than the second speed.

6. The device as recited in claim 5 wherein the first speed is a maximum speed and the second speed is a minimum speed.

7. The device as recited in claim 1 wherein the third pad and fourth pad receive the second printed product and define a second product path.

8. The device as recited in claim 1 wherein the second motor is 180° out of phase with respect to the second motor.

9. The device as recited in claim 1 wherein the first motor decelerates the first and second rotating supports while the second motor accelerates the third and fourth rotating supports.

10. The device as recited in claim 1 further comprising a controller for controlling the first and second motors.

11. The device as recited in claim 1 further comprising:

a fifth rotating support having a fifth pad mounted thereon;

a sixth rotating support having a sixth pad mounted thereon, the fifth pad having a different thickness than the sixth pad, the fifth and sixth rotating supports rotating together with the first and second rotating supports;

a seventh rotating support having a seventh pad mounted thereon; and an eighth rotating support having an eighth pad mounted thereon, the seventh pad having a different thickness than the eighth pad, the seventh and eighth rotating supports rotating together with the third and fourth rotating supports.

12. The device as recited in claim 11 wherein the first and second and fifth and sixth rotating supports are interspersed with the third and fourth and seventh and eighth rotating supports.

13. A device for diverting printed products comprising:

a first rotating support having a first pad mounted thereon;

a second rotating support having a second pad mounted thereon, the first pad having a different thickness than the second pad, the first and second rotating supports rotating together;

a third rotating support having a third pad mounted thereon;

a fourth rotating support having a fourth pad mounted thereon, the third pad having a different thickness than the fourth pad, the third and fourth rotating supports rotating together;

a first motor for controlling the first and second rotating supports; and a second motor for controlling the third and fourth rotating supports, the first motor and second motor having cyclical velocity profile curves.

14. The device as recited in claim 13 wherein the cyclical velocity profile curves are sinusoidal velocity profile curves.

15. A method for diverting printed products comprising:

rotating a first support having a first pad mounted thereon and a second support having a second pad mounted thereon, the first pad having a thickness different than the second pad;

rotating a third support having a third pad mounted thereon and a fourth support having a fourth pad mounted thereon, the third pad having a thickness different than the fourth pad;

transporting a first printed product between the first pad and second pad via a first path;

transporting a second printed product between the third pad and fourth pad via a second path;

decelerating the first printed product; and decelerating the second printed product.

16. A method for diverting printed products comprising:

rotating a first support having a first pad mounted thereon and a second support having a second pad mounted thereon, the first pad having a thickness different than the second pad;

rotating a third support having a third pad mounted thereon and a fourth support having a fourth pad mounted thereon, the third pad having a thickness different than the fourth pad;

transporting a first printed product between the first pad and second pad via a first path; and transporting a second printed product between the third pad and fourth pad via a second path, wherein the step of rotating the first support and second support includes using a first motor and the step of rotating the third support and fourth support includes using a second motor, the first and second motors being out of phase with each other.

* * * * *